US011543108B2

(12) United States Patent
Chang

(10) Patent No.: US 11,543,108 B2
(45) Date of Patent: Jan. 3, 2023

(54) READILY ASSEMBLED/DISASSEMBLED LAMP

(71) Applicant: Herman Chang, Rancho Dominguez, CA (US)

(72) Inventor: Herman Chang, Rancho Dominguez, CA (US)

( * ) Notice: Subject to any disclaimer, the term of this patent is extended or adjusted under 35 U.S.C. 154(b) by 0 days.

(21) Appl. No.: 17/558,444

(22) Filed: Dec. 21, 2021

(65) Prior Publication Data

US 2022/0196229 A1 Jun. 23, 2022

Related U.S. Application Data

(60) Provisional application No. 63/129,084, filed on Dec. 22, 2020.

(51) Int. Cl.

| | |
|---|---|
| ***F21V 21/14*** | (2006.01) |
| ***F21V 21/26*** | (2006.01) |
| ***F21V 23/06*** | (2006.01) |
| ***F21V 23/00*** | (2015.01) |
| *F21Y 115/10* | (2016.01) |

(52) U.S. Cl.

CPC ..... *F21V 21/145* (2013.01); *F21V 21/26* (2013.01); *F21V 23/003* (2013.01); *F21V 23/06* (2013.01); *F21Y 2115/10* (2016.08)

(58) Field of Classification Search

CPC ..... F21V 21/145; F21V 24/26; F21V 14/02; F21V 23/003; F21V 23/06; F21Y 2115/10; F21S 6/004; F21S 6/003

See application file for complete search history.

(56) References Cited

U.S. PATENT DOCUMENTS

| | | | | |
|---|---|---|---|---|
| 2003/0016532 | A1* | 1/2003 | Reed | F21V 23/04 362/198 |
| 2019/0162396 | A1* | 5/2019 | Sonneman | F21V 21/30 |

FOREIGN PATENT DOCUMENTS

| | | | | |
|---|---|---|---|---|
| CN | 105927894 | A * | 9/2016 | F21L 4/08 |
| CN | 107820555 | A * | 3/2018 | F21L 4/02 |
| CN | 107980088 | A * | 5/2018 | F21L 4/00 |
| CN | 110486648 | A * | 11/2019 | |
| WO | WO-0179751 | A1 * | 10/2001 | F21S 6/003 |
| WO | WO-2011118354 | A1 * | 9/2011 | F21S 2/00 |

* cited by examiner

*Primary Examiner* — Anabel Ton

(74) *Attorney, Agent, or Firm* — Matthew J. Spark; Stefan J. Kirchanski; Zuber Lawler LLP

(57) ABSTRACT

An adjustable lamp includes a base, a riser configured to be attached to the base, and an adjustment arm including a lamp head. The adjustment arm is configured to be removably engaged to the riser. The adjustment arm is slidably moveable relative to the riser along a longitudinal length of the adjustment arm such that the distance between the lamp head and the riser can be increased or decreased. The adjustment arm includes a plurality of electrical buses configured for electrical-mechanical engagement with the riser when the adjustment arm is attached to the riser, and the LED lamp head is configured for electrical communication with the plurality of electrical buses.

5 Claims, 4 Drawing Sheets

READILY ASSEMBLED/DISASSEMBLED LAMP

CROSS-REFERENCE TO PRIOR APPLICATIONS

This application is the utility version of and claims priority and benefit of U.S. Provisional Patent Application No. 63/129,084 filed 22 Dec. 2020, which is incorporated herein in its entirety.

BACKGROUND OF THE INVENTION

Area of the Art

The present invention is in the area of illumination and is more specifically directed to a lamp that is readily assembled/disassembled.

Description of the Background Art

Electric lighting has completely changed people's way of life. No longer do we go to bed at sundown; no longer do we light our homes with smoking and potentially dangerous oil lamps and candles that use flames to provide illumination. One of the great advantages of electric lights is that plug-in lamps can be placed almost any place to provide illumination and to act as decorative as well as utilitarian objects. For many years, the only choices in electric lamps were "incandescent lamps" or "fluorescent lamps." Lamps based on incandescent bulbs are versatile and relatively inexpensive because they do not require specialized power supplies. Incandescent bulbs come in a wide variety of shapes, sizes and configurations. Incandescent bulbs are particularly well-suited for "spot light" configurations because they are point sources which allows the outputted light to be readily focused and because they are available in configurations that include a built-in reflector and focusing arrangement (e.g., floodlights). The major drawbacks of incandescent bulbs are that they get dangerously hot during operation and are relatively energy inefficient. Lamps that use fluorescent bulbs are considerably more energy efficient and are relatively cool in operation. However, fluorescent bulbs require a complex power supply (ballast) which adds cost and weight to the fluorescent lamps. In addition, fluorescent bulbs are generally linear tube-like structures so that the size and shape of the lamps are limited. Usually tube-like fluorescent bulbs are useless for spot light application although this limitation is overcome by compact fluorescent bulbs that can be used in most applications where an incandescent light bulb would be appropriate. Moreover, all fluorescent bulbs contain a small amount of mercury that is extremely toxic and requires specialized disposal of spent bulbs.

Incandescent bulbs as well as compact fluorescent bulbs are less successful in situations where an even source of illumination is necessary, such as on a desk or other worktop area. Over the last decade or two there has been a veritable revolution in lighting, particularly desk lighting. It was not all that long ago that desk lamps consisted of ordinary lamps with shades (not unlike ordinary living room lamps) or the ubiquitous "gooseneck" lamps with single incandescent bulbs with metallic shades. There were also fluorescent desk lamps wherein a rectangular housing for a one-foot fluorescent tube perched on a "gooseneck" connector. A series of "architect" style lamps with a single bulb reflectors carried by cantilevered, jointed arms could be adjusted to provide light to almost any part of the work surface of a desk or table were also quite popular. Both incandescent and fluorescent lamps are being increasingly replaced by Light Emitting Diodes (LEDs). Compared to incandescent and fluorescent bulbs, LEDs are more energy efficient as well as cool during operation. LEDs do require a special direct current (DC) power supply, but this is usually lighter and less expensive than the power supply required by fluorescent lamps. Furthermore, because LEDs have extremely long operating lives, sockets that allow individual lamp bulbs to be replaced are usually omitted, thereby lowering fabrication costs. Thus, LEDs are ideal for most lamp applications.

As pointed out above, prior to the rise of LEDs, the only common light sources were either incandescent bulbs or fluorescent tubes (e.g., straight, circular, spiral, etc.). Because of concerns for energy efficiency, LED lights have been rapidly replacing incandescent and fluorescent lights, particularly for desk illumination. As pointed out above, LED lights were initially designed directly to replace incandescent bulbs and fluorescent tubes. However, LED light sources are smaller and lighter than either incandescent bulbs or fluorescent tubes, and these characteristics have spawned an entire new generation of designer LED desk lamps. The low weight and small size of LED light sources has enabled a variety of designs where relatively small light heads are mounted to a variety of flexible, adjustable arms and similar support mechanisms. However, even these LED desk lamps have their issues.

Essentially, an LED desk lamp consists of a base with a power cord having a plug for connection or attachment to an electrical outlet. Some sort of usually adjustable support arm is attached to the base. The support arm bears one or more LED packages. The low weight and sturdiness of LED-based desk lamps supports ready shipment and delivery of the units directly to the consumers. Unfortunately, the large variety of design shapes and sizes enabled by LEDs are often difficult to pack for easy shipment and setup by the consumer. The typical base plus support arm design is difficult to pack tor shipment because electrical wires normally prohibit ready removal of the support arm from the base. A similar problem exists when the user moves to a new home or job, and wishes to bring their desk lamp with them.

Accordingly, there is a need for an improved lamp. There is a further need for a desk lamp. There is also a need for a lamp that is readily disassembled/assembled. There is a need for a lamp that uses LEDs. There is an additional need for a lamp that is easier to manufacture, assemble, adjust, and maintain. The present invention satisfies these needs and provides other related advantages.

SUMMARY OF THE INVENTION

An embodiment of the present invention provides an improved lamp. An embodiment of the present invention provides a desk lamp. An embodiment of the present invention provides a lamp that is readily disassembled/assembled. An embodiment of the present invention uses LEDs. An embodiment of the present invention provides a lamp that is easier to manufacture, assemble, adjust, and maintain. An embodiment of the present invention satisfies these needs and provides other related advantages.

The present invention provides sliding contacts to replace conventional wires that connect the LED packages and the support with the base.

In accordance with an embodiment of the present invention, an adjustable LED lamp includes a base; a riser configured to be attached to the base; and an adjustment arm including a lamp head. The adjustment arm is configured to be removably engaged to the riser, and the adjustment arm is slidably moveable relative to the riser along a longitudinal length of the adjustment arm such that the distance between the lamp head and the riser can be increased or decreased. The adjustment arm includes a plurality of electrical buses configured for electrical-mechanical engagement with the riser when the adjustment arm is attached to the riser. The lamp head is configured for electrical communication with the plurality of electrical buses.

In accordance with another embodiment of the present invention, the adjustment arm includes a track running at least portion of a length of the adjustment arm.

In accordance with still another embodiment of the present invention, the track includes a plurality of electrical buses in electrical communication with the power supply when the adjustment arm is attached to the riser.

In accordance with a further embodiment of the present invention, the lamp head slidingly engages the track and is in electrical communication with the electrical buses.

In accordance with yet another embodiment of the present invention, an adjustable LED lamp includes a base; a riser attached to the base and in electrical communication with a power supply; an adjustment arm removably attachable to the riser with a track running at least part of a length of the adjustment arm; a plurality of electrical buses associated with the track which buses are brought into electrical communication with the power supply when the adjustment arm is attached to the riser; and an LED lamp head slidingly interacting with the track and in electrical communication with the electrical buses.

Other features and advantages of the present invention will become apparent from the following more detailed description, taken in conjunction with the accompanying drawings, which illustrate, by way of example, the principles of the invention

DESCRIPTION OF THE FIGURES

The various present embodiments now will be discussed in detail with an emphasis on highlighting the advantageous features with reference to the drawings of various embodiments. The illustrated embodiments are intended to illustrate, but not to limit the invention. These drawings include the following figures, in which like numerals indicate like parts.

DETAILED DESCRIPTION OF THE INVENTION

Figure 1:
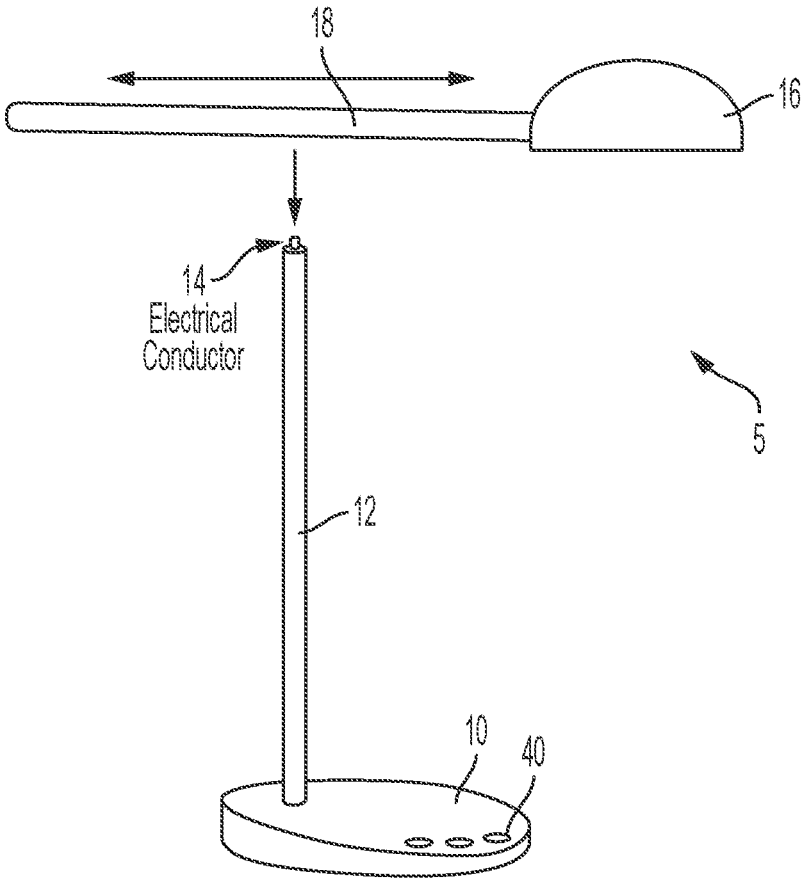
FIG. 1 illustrates a lamp in accordance with an embodiment of the present invention, with a double-headed arrow indicating longitudinal movement of the adjustment arm relative to the riser, and an arrow indicating lowering of the adjustment arm to electro-mechanically engage the riser.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a readily adjustable desk lamp that is readily disassembled for shipping and readily assembled for use. The following detailed description describes the present embodiments, with reference to the accompanying drawings. In the drawings, reference numbers label elements of the present embodiments. These reference numbers are reproduced below in connection with the discussion of the corresponding drawing features. It is to be understood that the figures and descriptions of the present invention have been simplified to illustrate elements that are relevant for a clear understanding of the present invention, while eliminating, for the purpose of clarity, many other elements found in paper shredders. Those of ordinary skill in the pertinent arts may recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the pertinent arts.

Figure 2B:
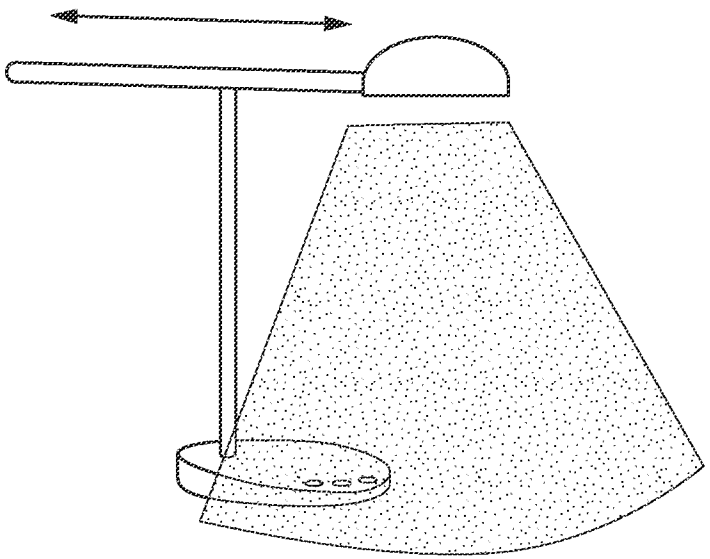
FIG. 2B illustrates the lamp of FIG. 1 in another configuration of the adjustment arm relative to the riser that illustrates even distribution of light from the light source to a worktop, with a double-headed arrow indicating longitudinal movement of the adjustment arm relative to the riser.
Figure 2A:
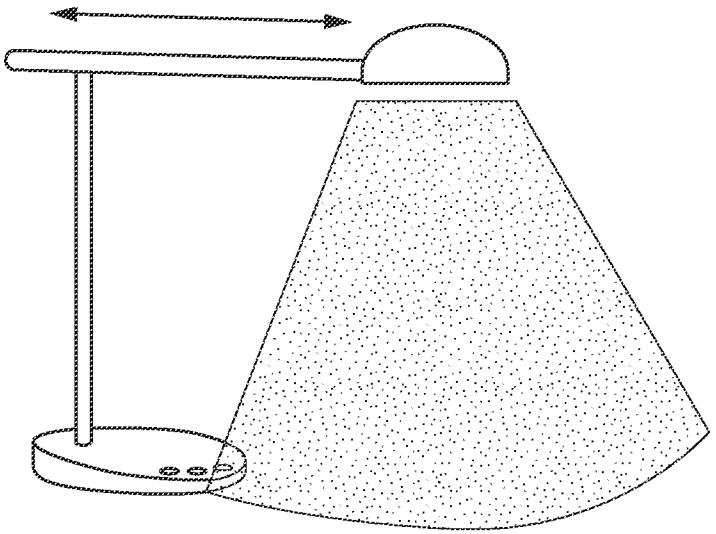
FIG. 2A illustrates the lamp of FIG. 1 in one configuration of the adjustment arm relative to the riser that illustrates even distribution of light from the light source to a worktop, with a double-headed arrow indicating longitudinal movement of the adjustment arm relative to the riser.
Figure 3:
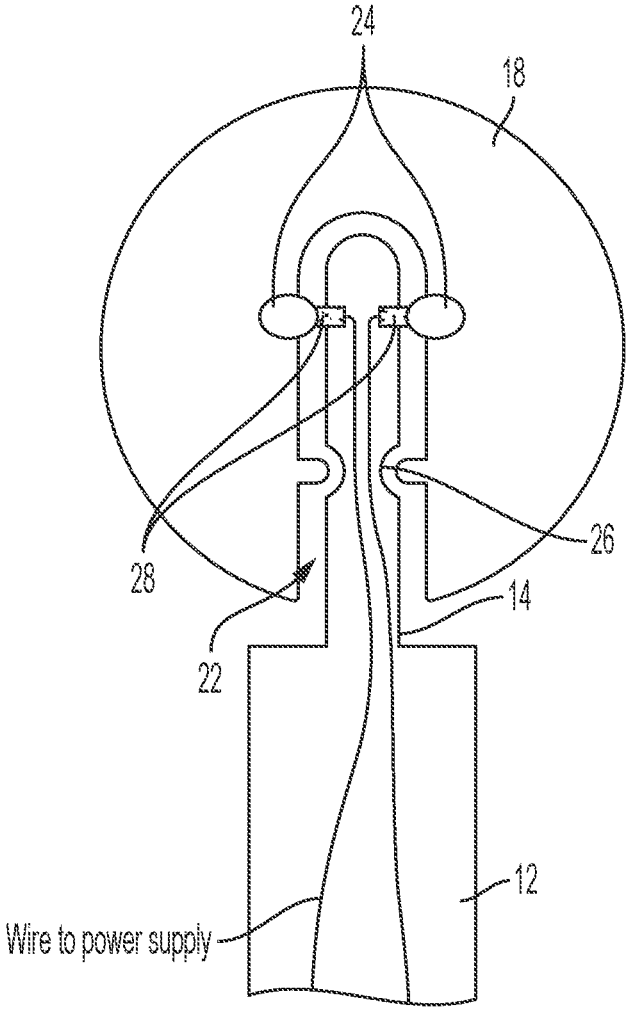
FIG. 3 illustrates a cross-sectional view of the lamp of FIG. 1 that illustrates engagement of the adjustment arm and the riser.

As shown in FIGS. 1-3 for purposes of illustration, an embodiment of the present invention resides in a lamp assembly 5 that includes a base 10. The base 10 supports a riser 12 through which conductors (e.g., wires, metal strips, etc.) from a power supply (not shown) within the base 10 attach to an electrical conductor 14 at the apex of the riser 12. A lamp head 16 contains one or more LEDs (not shown) and is attached to one end of an adjustment arm 18. The adjustment arm 18 electro-mechanical engages the riser 12 as the underside of the adjustment arm 18 has a hollow slot or track 22 into which the electrical conductor 14 snaps to complete the electrical circuit from the power supply to the lamp head 16. Sliding conductors allow the adjustment arm 18 to move back and forth along the track 22 relative to the riser 12 (as shown in FIG. 2). This not only provides a wide range of positional adjustments for the lamp head 16 along the track 22, it also allows the lamp head 16 and adjustment arm 18 to be readily removed for shipping purposes and reassembled by a user (as shown in FIG. 1). In the alternative, the riser 12 may also be removably engaged to the base 10 and in electro-mechanical engagement therewith.

This ready removal of the lamp head 16 and adjustment arm 18 without worrying about making wiring changes also makes it very simple for the manufacturer to switch in and out a variety of lamp head and adjustment arm combinations (different wattages or colors and/or different arm lengths and lamp head configurations) as well as the ability to sell different lamp heads for the consumer to switch in and out at will. FIG. 3 shows a cross-section through the adjustment arm 18 to show the track 22. In this embodiment, electrical buses 24 (e.g., usually copper or other conductive metal or metal alloy) are provided on either side of the slot 22. FIG. 3 also shows the electrical conductor 14 positioned within the slot. The interaction between the electrical conductor 14 and the slot 22 can be stabilized by optional slots 26 in the electrical conductor (which can be inserted into the track 22 at the distal end of the adjustment arm 18). The electrical conductor 14 also bears spring-loaded contacts 28 that provide the sliding connection between the power supply (in the base) and the electrical buses 24. This specific configuration is for illustration purposes only because a wide variety of sliding contacts are known and will be known to one of skill in the art. The LEDs (not shown) in the lamp head 16 are energized by a DC voltage, normally between about 6 and 12 volts, delivered to the electrical conductor 14 and communicated to the buses 24 by the contacts 28. It will be appreciated that the lamp head 16 is in electrical communication with the buses 24. Therefore, even though it is possible for a consumer to touch the contacts 28 on the electrical conductor 14 when the adjustment arm 18 is removed from the track, the voltage is too low to be at all harmful. Nevertheless, if it is desired to protect the power supply from short circuits, it is possible to provide a microswitch or other similar arrangement that cuts off the power to one of the contacts 28 when the electrical conductor 14 is not inserted into the slot 22.

Figure 4:
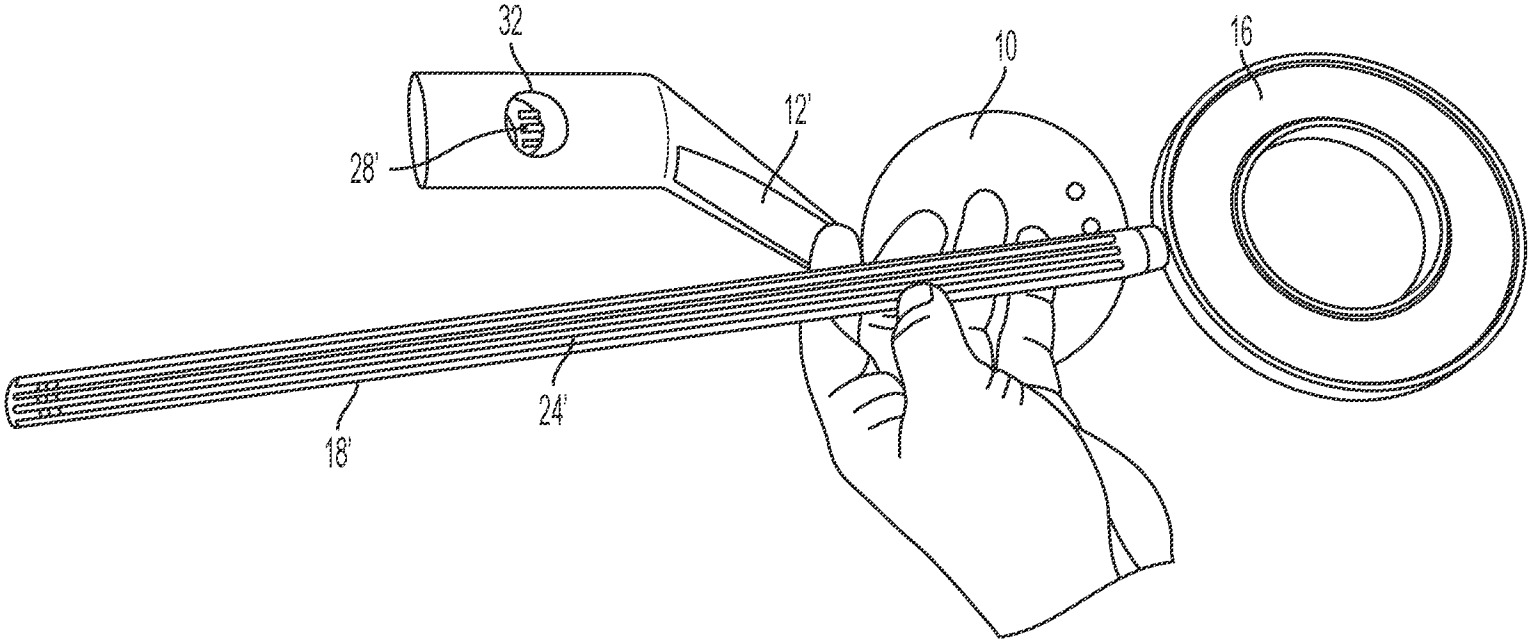
FIG. 4 illustrates a lamp in accordance with another embodiment of the present invention that shows the base resting on a worktop, with the riser extending upward from the base, and with a user holding the adjustment arm and lamp head which are disengaged from the riser.

FIG. 4 illustrates an alternate embodiment where the adjustment arm 18' is inserted into an aperture 32 in the riser 12'. In this embodiment, the contacts 28' are located inside of the aperture 32 and the electrical buses 24' are conductive strips disposed on the lower surface of the adjustment arm 19'. The sliding connection provided by the interaction between the contacts 29' and the electrical buses 24' also stabilize and support the adjustment arm 18'.

A printed circuit (PC) board (not shown) contains all the necessary power supply components as well as power traces to provide power to each LED chip. Therefore, it is simple to provide an array of spaced apart LED chips within the lamp head 16 that are configured to provide a band of even illumination. The lamp head 16 can include a diffuser (as seen in FIG. 4) so that a relatively simple translucent diffuser can result in extremely even illumination, as seen in FIGS. 2A and 2B. The PC Board can be hard or flexible. While the PC Board can be located within the base 10, it can also be located elsewhere in the lamp assembly 5. For example, if the PC Board is flexible, it can be readily shaped to conform to the shape of the interior of the lamp head 16 and positioned near the LEDs. The LED chips themselves can be located on the PC board. For lamps with "free-form" curved shapes, the flexible PC board can be molded (e.g., vacuum-formed) to precisely mirror the lamp shape. In the case of lamps having an angular, triangular or rectangular shape, the circuit board can be bent sharply or creased at the corners. The number, power and placement of the LED chips can be readily adjusted to provide the desired evenness of illumination.

It is also simple to use color-changing (RGB) LED chips so that the color as well as the brightness of the lamp is adjustable. It will be appreciated that color changing LED chips as well as white LED chips having different color temperatures can be provided on the same flexible PC board (if the LED chips are located on the PC Board). If pure colored illumination is desired, only the color-changing LEDs are energized and then adjusted to provide the desired color. When white illumination is desired, only the "white" chips are energized. Overall color temperature can be changed by selectively energizing "warm white" LEDs or "cool white" LEDs or some mixture thereof. Energizing various types of white LEDs along with the color-changing LEDs can provide additional effects.

As mentioned previously, LEDs require a low voltage DC power supply. While it is possible to use a "power brick" transformer located outside of the lamp (e.g., at the end of a power cord by the plug), a transformer or appropriate voltage conversion circuits can also be placed inside the lamp (as described above where some or all of the power conversion circuitry can be located on a PC board located within the base 10 or lamp head 16). Control circuits for the color-changing and other lamp features can be totally or partially located on the PC board as well.

The base 10 includes a number of buttons or switches 40 that are used to control the lamp assembly 5. These buttons or switches 40 include, without limitation, power on/off, LED dimming, LED color change, and the like.

In the alternative, the base 10 may include a USB port for charging of mobile phones or other electrical devices. In a further alternative, the base 10 may include a battery compartment for holding rechargeable batteries so that the lamp assembly 5 can be operated in the event of a power failure or in the event a user wishes to use the lamp assembly 5 in a location where, for example, there is no electrical socket in the immediate vicinity.

In addition, the claimed invention is not limited in size and may be constructed in various sizes in which the same or similar principles of operation as described above would apply. Furthermore, the figures (and various components shown therein) of the specification are not to be construed as drawn to scale.

The terminology used herein is for the purpose of describing particular example embodiments only and is not intended to be limiting. As used herein, the singular forms "a", "an" and "the" may be intended to include the plural forms as well, unless the context clearly indicates otherwise. In other words, an element or step recited in the singular and preceded by the word "a" or "an" should be understood as not necessarily excluding the plural of the elements or steps. Further, references to "one embodiment" or "one implementation" are not intended to be interpreted as excluding the existence of additional embodiments or implementations that also incorporate the recited features.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps. In other words, unless explicitly stated to the contrary, embodiments "comprising" or "having" an element or a plurality of elements having a particular property can include additional elements not having that property. In other words, the terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. In other words, the use of "including," "comprising," "having," "containing," "involving," and variations thereof, is meant to encompass the items listed thereafter and additional items. Further, references to "one embodiment" or "one implementation" are not intended to be interpreted as excluding the existence of additional embodiments or implementations that also incorporate the recited features. The term "exemplary" is intended to mean "an example of".

When introducing elements of aspects of the disclosure or the examples thereof, the articles "a," "an," "the," and "said" are intended to mean that there are one or more of the elements. In other words, the indefinite articles "a", "an", "the", and "said" as used in the specification and in the claims, unless clearly indicated to the contrary, should be understood to mean "at least one." The use of the expression "at least" or "at least one" suggests the use of one or more elements or ingredients or quantities, as the use may be in the embodiment of the disclosure to achieve one or more of the desired objects or results.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary. Any range or value given herein can be extended or altered without losing the effect sought, as will be apparent to the skilled person.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

While various spatial and directional terms, such as "top," "bottom," "upper," "lower," "vertical," and the like are used to describe embodiments and implementations of the present disclosure, it is understood that such terms are merely used with respect to the orientations shown in the drawings. The orientations can be inverted, rotated, or otherwise changed, such that a top side becomes a bottom side if the structure is flipped 180 degrees, becomes a left side or a right side if the structure is pivoted 90°, and the like. In other words, spatially relative terms, such as "front," "rear," "left," "right," "inner," "outer," "beneath", "below", "lower", "above", "upper", "horizontal", "vertical", "lateral", "longitudinal" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

It will be understood that the benefits and advantages described above can relate to one embodiment or can relate to several embodiments. The embodiments are not limited to those that solve any or all of the stated problems or those that have any or all of the stated benefits and advantages. It will further be understood that reference to 'an' item refers to one or more of those items.

The order of execution or performance of the operations in examples of the disclosure illustrated and described herein is not essential, unless otherwise specified. That is, the operations can be performed in any order, unless otherwise specified, and examples of the disclosure can include additional or fewer operations than those disclosed herein. For example, it is contemplated that executing or performing a particular operation before, contemporaneously with, or after another operation (e.g., different steps, etc.) is within the scope of aspects and implementations of the disclosure. In other words, the method steps, processes, and operations described herein are not to be construed as necessarily requiring their performance in the particular order discussed or illustrated, unless specifically identified as an order of performance. It is also to be understood that additional or alternative steps may be employed.

The phrase "one or more of the following: A, B, and C" means "at least one of A and/or at least one of B and/or at least one of C." The phrase "and/or", as used in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used shall only be interpreted as indicating exclusive alternatives (i.e. "one or the other but not both") when preceded by terms of exclusivity, such as "either," "one of" "only one of" or "exactly one of." "Consisting essentially of," when used in the claims, shall have its ordinary meaning as used in the field of patent law.

As briefly discussed above, as used in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

It is to be understood that the above description is intended to be illustrative, and not restrictive. For example, the above-described embodiments (and/or aspects thereof) can be used in combination with each other. In addition, many modifications can be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are example embodiments. Many other embodiments will be apparent to those of ordinary skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person of ordinary skill in the art to practice the various embodiments of the disclosure, including making and using any devices or systems and performing any incorporated methods. The patentable scope of the various embodiments of the disclosure is defined by the claims, and can include other examples that occur to those persons of ordinary skill in the art. Such other examples are intended to be within the scope of the claims if the examples have structural elements that do not differ from the literal language of the claims, or if the examples include equivalent structural elements with insubstantial differences from the literal language of the claims.

The above description presents the best mode contemplated for carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above that are fully equivalent. Moreover, features described in connection with one embodiment of the invention may be used in conjunction with other embodiments, even if not explicitly stated above. Consequently, this invention is not limited to the particular embodiments disclosed. On the contrary, this invention covers all modifications and alternate constructions coming within the spirit and scope of the invention as generally expressed by the following claims, which particularly point out and distinctly claim the subject matter of the invention.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

What is claimed is:

1. An adjustable lamp comprising:

a base;

a riser configured to be attached to the base; and an adjustment arm including an LED lamp head; wherein the adjustment arm is configured to be removably engaged to the riser; wherein the adjustment arm is slidably moveable relative to the riser along a longitudinal length of the adjustment arm such that the distance between the LED lamp head and the riser can be increased or decreased;

wherein the adjustment arm includes a plurality of electrical buses configured for electrical-mechanical engagement with the riser when the adjustment arm is attached to the riser, and wherein the LED lamp head is configured for electrical communication with the plurality of electrical buses.

2. The adjustable lamp of claim 1, wherein the adjustment arm includes a track running at least portion of a length of the adjustment arm.

3. The adjustable lamp of claim 2, wherein the track includes a plurality of electrical buses in electrical communication with the power supply when the adjustment arm is attached to the riser.

4. The adjustable lamp of claim 3, wherein the LED lamp head slidingly engages the track and is in electrical communication with the electrical buses.

5. An adjustable LED lamp comprising:

a base;

a riser attached to the base and in electrical communication with a power supply;

an adjustment arm removably attachable to the riser with a track running at least part of a length of the adjustment arm;

a plurality of electrical buses associated with the track which buses are brought into electrical communication with the power supply when the adjustment arm is electro-mechanically attached to the riser; and an LED lamp head slidingly interacting with the track and in electrical communication with the electrical buses.

* * * * *